US007785078B2

(12) United States Patent
Calamai

(10) Patent No.: US 7,785,078 B2
(45) Date of Patent: Aug. 31, 2010

(54) METHOD AND SYSTEM FOR MONITORING A RECIPROCATING COMPRESSOR

(75) Inventor: Enrico Calamai, Pistoia (IT)

(73) Assignee: Nuovo Pignone Holding S.p.A., Florence (IT)

( * ) Notice: Subject to any disclaimer, the term of this patent is extended or adjusted under 35 U.S.C. 154(b) by 664 days.

(21) Appl. No.: 10/539,378

(22) PCT Filed: Dec. 5, 2003

(86) PCT No.: PCT/EP03/14059

§ 371 (c)(1),
(2), (4) Date: Feb. 6, 2006

(87) PCT Pub. No.: WO2004/055372

PCT Pub. Date: Jul. 1, 2004

(65) Prior Publication Data

US 2006/0153692 A1 Jul. 13, 2006

(30) Foreign Application Priority Data

Dec. 16, 2002 (IT) ..... MI02A002642

(51) Int. Cl.
*F04B 49/00* (2006.01)
*F04B 43/12* (2006.01)
*G05D 7/00* (2006.01)

(52) U.S. Cl. ..... 417/63; 417/53; 700/282

(58) Field of Classification Search ..... 417/53, 417/63, 13; 62/126, 127, 209, 228.1, 128–129; 700/282

See application file for complete search history.

(56) References Cited

U.S. PATENT DOCUMENTS

| | | | | |
|---|---|---|---|---|
| 3,961,862 | A * | 6/1976 | Edstrom et al. | 417/282 |
| 4,149,827 | A * | 4/1979 | Hofmann, Jr. | 417/12 |
| 4,227,862 | A * | 10/1980 | Andrew et al. | 417/12 |
| 4,502,833 | A * | 3/1985 | Hibino et al. | 415/17 |
| 4,990,057 | A * | 2/1991 | Rollins | 417/12 |
| 5,059,097 | A | 10/1991 | Okazaki et al. | |
| 5,209,076 | A * | 5/1993 | Kauffman et al. | 62/126 |
| 5,772,403 | A * | 6/1998 | Allison et al. | 417/44.2 |
| 5,967,757 | A * | 10/1999 | Gunn et al. | 417/34 |
| 6,017,192 | A * | 1/2000 | Clack et al. | 417/18 |
| 6,390,779 | B1 * | 5/2002 | Cunkelman | 417/14 |

(Continued)

FOREIGN PATENT DOCUMENTS

GB 2251492 A 10/1991

(Continued)

OTHER PUBLICATIONS

International Search Report for PCT/EP2003/014059, mailed Mar. 8, 2004.

*Primary Examiner*—Charles G Freay
*Assistant Examiner*—Alexander B Comley
(74) *Attorney, Agent, or Firm*—Potomac Patent Group PLLC

(57) ABSTRACT

System for monitoring a reciprocating compressor, comprising a unit for measuring parameters relating to the operating state of the compressor, a processing unit for comparing the values of these measured parameters with critical values contained in a database associated with the said processing unit. This processing unit sends a signal determined by a match between the measured values and the critical values; this signal represents an anomaly in the operating state of the compressor.

18 Claims, 2 Drawing Sheets

U.S. PATENT DOCUMENTS

Figure 1:
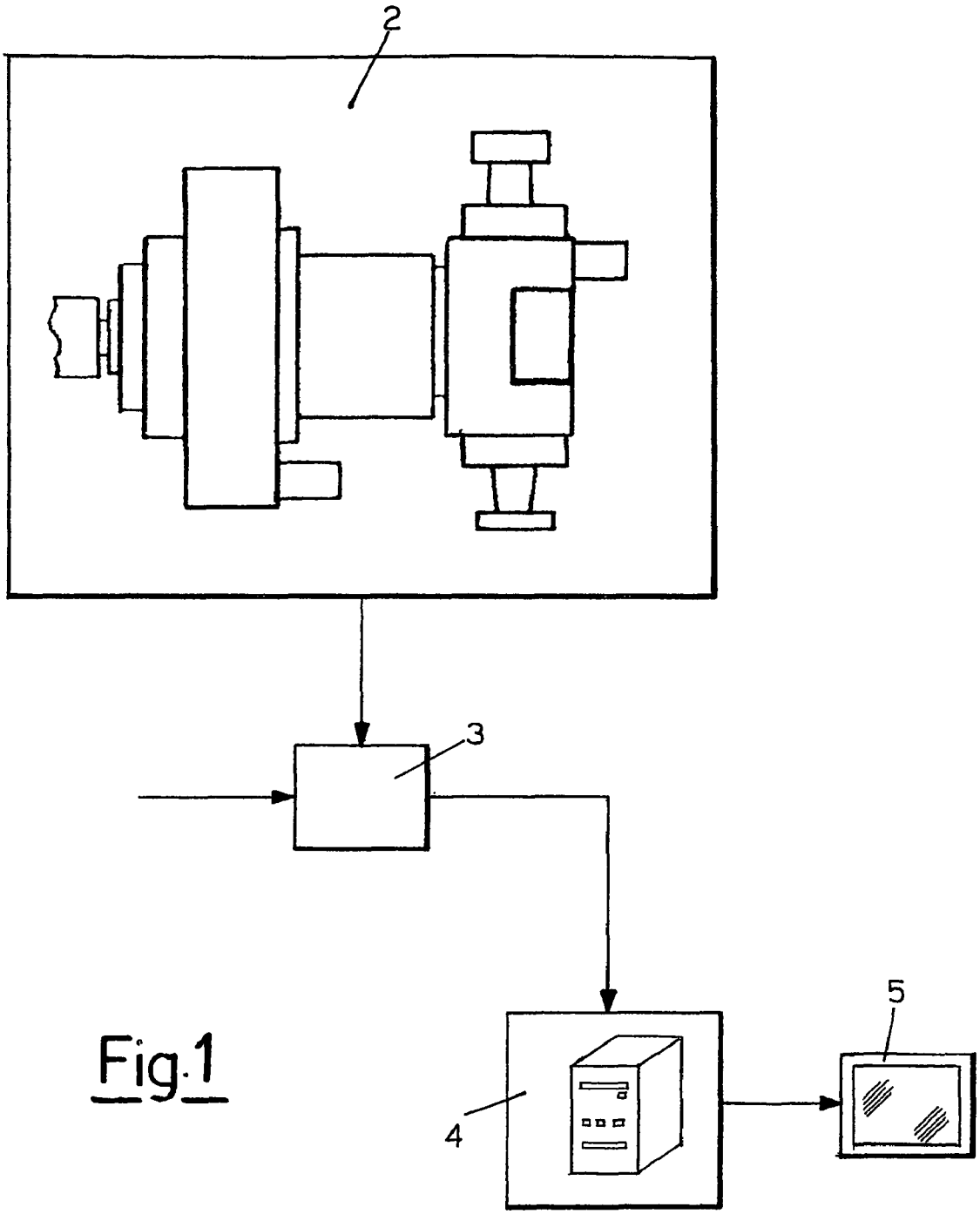

| | | | | |
|---|---|---|---|---|
| 6,394,758 | B1 * | 5/2002 | Lee et al. | 417/13 |
| 6,448,982 | B1 * | 9/2002 | Klapper et al. | 715/764 |
| 6,799,951 | B2 * | 10/2004 | Lifson et al. | 417/53 |
| 2001/0022938 | A1 * | 9/2001 | Blotenberg | 417/53 |
| 2002/0141877 | A1 * | 10/2002 | Jayanth et al. | 417/63 |
| 2003/0077179 | A1 * | 4/2003 | Collins et al. | 417/63 |
| 2005/0025631 | A1 * | 2/2005 | Lake | 417/63 |

FOREIGN PATENT DOCUMENTS

| | | | |
|---|---|---|---|
| JP | 3-000986 | A | 1/1991 |
| JP | 2000-205140 | A | 7/2000 |
| JP | 2001-245974 | A | 9/2001 |

* cited by examiner

METHOD AND SYSTEM FOR MONITORING A RECIPROCATING COMPRESSOR

CROSS-REFERENCE TO RELATED APPLICATIONS

This application is a National Phase Application of International Application No. PCT/EP2003/014059, filed Dec. 5, 2003, which claims the priority of Italian Patent Application No. MI2002A002642, filed Dec. 16, 2002. The present application claims priority from both applications.

The present invention relates to a method and a system for monitoring a reciprocating compressor.

In particular, the present invention relates to a method and a system for monitoring a reciprocating compressor which enables a real-time and predictive diagnosis of the faults and malfunctions of the compressor to be made.

The compression of gas requires various types of machine, including reciprocating compressors and their corresponding fittings, accessories and operating systems. Reciprocating machines have the advantage of high efficiency and flexibility of operation.

As is known, a reciprocating compressor is a processing machine whose output is a compressible fluid (gas) at a pressure greater than that at which the fluid was received.

The reciprocating compressor operates with at least one cylinder which is made to communicate at appropriate moments with a delivery environment or with an intake environment; the fluid is drawn in from the intake environment and then compressed, and finally discharged to the outside.

In particular, reciprocating compressors operate with variations of volume of a working chamber, obtained by the rectilinear movement of a rigid body along the generatrices of a cylindrical cavity, and can be operated by means of a crank mechanism for converting a continuous circular motion, such as that generally provided by electric and thermal motors, to a reciprocating motion, as required in this particular case.

An example of a reciprocating compressor is described in patent application EP 1,184,570 in the name of the present applicant.

It is known that reciprocating compressors now yield extremely high levels of availability, owing to the use of advanced materials, design and simulation methods, and plant automation and control systems.

Recent automated systems make a considerable contribution to new installations and to the modernization of existing systems in terms of safety, ease of operation and monitoring of the efficiency of the machinery, and create competitiveness in the chemical, petrochemical and general industrial sectors.

An article with the title "Controllo e diagnostica dei compressori alternativi" ["Monitoring and diagnosis of reciprocating compressors"] published in the journal "Manutenzione tecnica e management" in September 2002 describes how diagnostic systems make a real contribution to improved operating efficiency and availability.

The applicant has observed that, in known monitoring systems, data are acquired by measuring process variables of the compressor and are simply compared with fixed reference values.

The applicant has tackled the problem of increasing the significance of the information obtained from the data acquired during the operation of a reciprocating compressor, for monitoring the correct operation of the said compressor.

The applicant has provided a system and a method for monitoring a reciprocating compressor in which the measured data are processed and subsequently compared with previously stored data correlated with predetermined anomalies in a matrix which contains critical values of parameters relating to the operating state of the compressor. Thus the comparisons which are made enable any anomaly to be identified with a greater probability, since it is discovered by an analysis of the variations of the parameters encountered; for this purpose, the system according to the present invention displays in a suitable way any cause of the malfunction.

A first aspect of the present invention relates to a method for monitoring a reciprocating compressor, comprising the following steps:

- receiving a plurality of signals corresponding to parameters relating to the operating state of the compressor,
- comparing the measured values of these parameters with critical values contained in a database,
- sending a signal according to the match between the measured values and the critical values, the signal representing an anomaly of the operating state of the compressor.

A further aspect of the present invention relates to a system for monitoring a reciprocating compressor, comprising a unit for measuring parameters relating to the operating state of the compressor, a processing unit for comparing the measured values of the parameters with critical values contained in a database associated with the said processing unit, and for sending a signal according to the match between the measured values and the critical values, this signal representing an anomaly of the operating state of the compressor.

Figure 2:
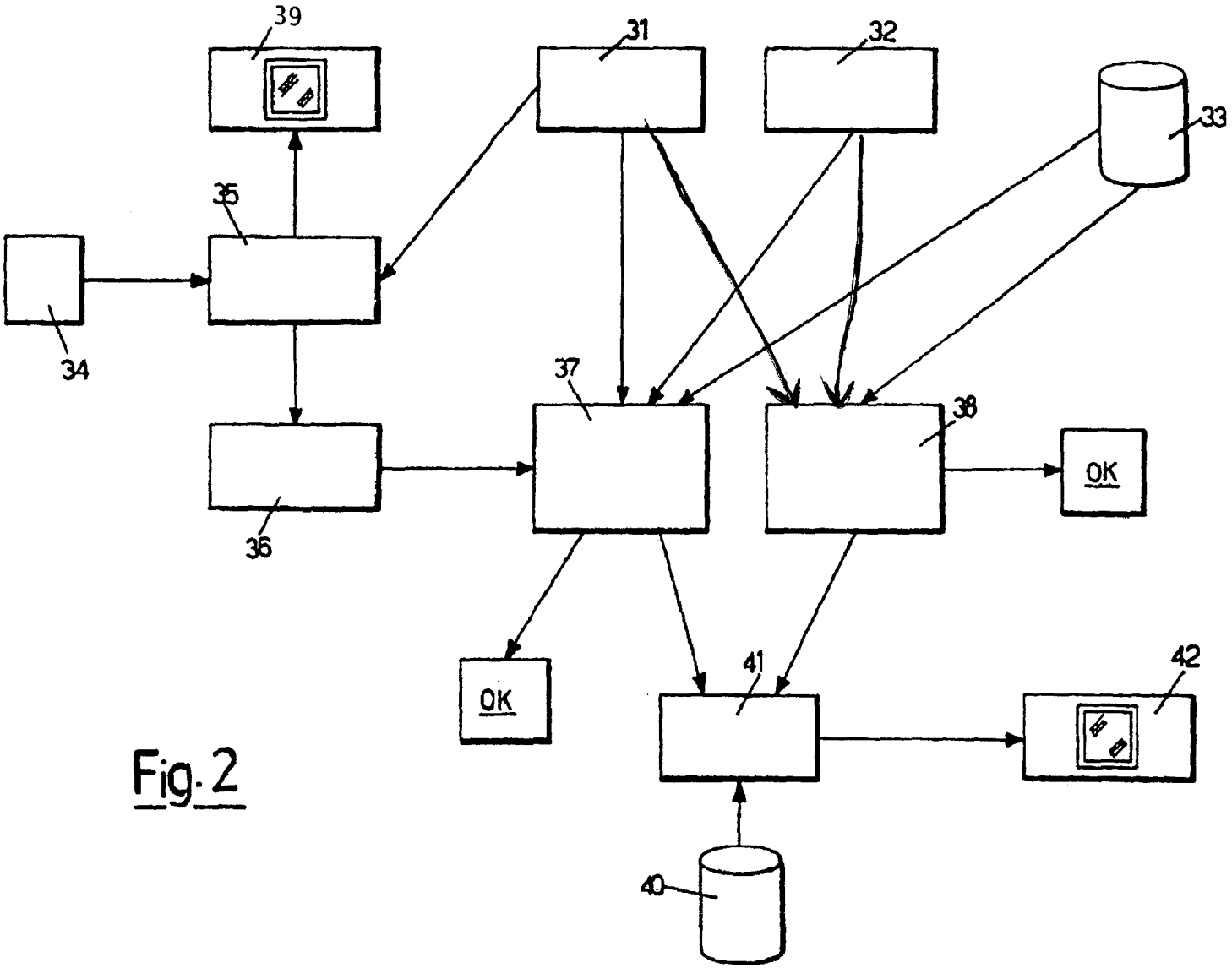

The characteristics and advantages of the monitoring method and system according to the present invention will be made clearer by the following description, provided by way of example and without restrictive intent, of one embodiment with reference to the attached figures, in which:

FIG. 1 is a block diagram of the monitoring system according to the present invention applied to a reciprocating compressor; and FIG. 2 is a block diagram of the operations carried out in a processing unit of the system according to the present invention.

With reference to the aforesaid figures, the system according to the present invention comprises a measuring unit 3 which receives signals from a plurality of sensors associated with a reciprocating compressor 2.

The signals from the sensors and the manually entered data represent parameters relating to the operating state of the compressor.

The system also comprises a processing unit 4 which communicates with the said measuring unit and a display unit 5 associated with the said processing unit.

The said processing unit comprises a microprocessor and at least one storage device.

This processing unit also contains within it a design database containing design parameters of the compressor. These design parameters are obtained, for example, by processing carried out with a program for designing reciprocating compressors.

The system according to the present invention comprises at least one program for monitoring these parameters relating to the operating state of the compressor and at least one diagnostic program, which, on the basis of the acquired data, detects an anomalous condition of the operation of the compressor.

The said monitoring program controls the measuring unit in such a way as to determine the parameters which are measured from the compressor by means of the sensors, the parameters entered manually by an operator, and the design parameters contained in the said database.

The said processing unit comprises at least one database, preferably arranged in the form of a matrix of previously stored data.

This matrix relates to a plurality of anomalies which can be identified, each of these being associated with a row of the matrix, while the columns of the matrix represent the parameters relating to the operating state of the compressor.

In particular, each row of the matrix relates to a specific anomaly identified by predetermined critical values of these parameters.

The diagnostic program operates in the following way.

When the parameters measured by the sensors and those entered manually by an operator have been received by means of the said monitoring program, a comparison is made between the measured parameters and the corresponding values of the critical parameters contained in each row of the matrix of anomalies.

FIG. 2 is a block diagram of the operations carried out in a processing unit of the system according to the present invention.

In particular, the said operations comprise the reading of all the necessary data, including a first step 31 of reading from the sensors associated with the reciprocating compressor, carried out by the said measuring unit 3, a second step 32 of reading the manually entered data, and a third step 33 of reading reference parameters stored in the said processing unit.

Additionally, other data to be compared are obtained from the design specifications 34 of the compressor, and are compared, in a preliminary comparison step 35, with the data 31 measured by the sensors.

On the basis of the measured data and the design specifications, the design program determines in this step whether or not there is conformity with the design conditions, and, if the outcome is positive, proceeds with the diagnostic program; if the outcome is negative, it sends a first display message 39 relating to the failure to conform to the design specifications. The results of this preliminary comparison are used as inputs for a design program for reciprocating compressors 36. The outputs of this design program form further comparison parameters.

After the step of reading all the data, a step of comparison is carried out, comprising a first comparison 37 made between the data measured by the sensors 31, the manually entered data 32, the data processed by the design program 36 and the reference parameters 33, and a second comparison made between the manually entered data 32 and the absolute values 33.

The said first comparison 37 analyses the reference parameters with respect to the data processed by the design program and the data measured by the sensors, and to those entered manually with respect to the said reference parameters.

The said second comparison 38 analyses the reference parameters with respect to the data measured by the sensors and to those entered manually.

Preferably, if the operation is correct, both comparisons cause a simple message to be sent, indicating correct operation.

If an anomaly is detected, for example because some measured data deviate too far from the reference parameters, a search 41 is made in the said matrix of anomalies 40 until a row meeting the processed conditions is found. At this point, the diagnostic program advantageously generates a message 42 which indicates the characteristics of the encountered anomaly.

Examples of the parameters relating to the operating state of the reciprocating compressor according to the present invention are the intake pressure of the $1^{st}$ stage of the compressor, the intake temperature of each stage, the delivery pressure of the last stage, the composition of the gas, the ambient temperature, the speed of rotation of the compressor and the temperature of the cooling fluid at the inlet and outlet of the compressor cylinders.

Preferably, mechanical parameters which can simulate the machine in question in the best possible way (rod length, bore, stroke, etc.) are also measured.

The aforesaid parameters, except for the mechanical ones, are advantageously processed by the design program to produce operating parameters such as the gas flow rate, the delivery pressure of each stage except the last, the delivery temperature of each stage, the power consumption and the forces acting on the crank mechanism.

These results, when appropriately compared (with the aforesaid reference parameters or with values obtained from mathematical relations or with the corresponding values measured in the field) will make it possible to determine whether the machine is operating in the design or safety conditions.

The comparison will make it possible to determine whether a variation found in the operating parameters is due to a "physiological" phenomenon, in other words one due to input factors, or a "pathological" phenomenon, in other words one due to anomalies.

Therefore, when the variations due to "pathological" phenomena have been "selected", the program will "fill in" the said predefined matrix of anomalies.

For example, the matrix shows approximately 60 anomalies or causes of faults, such as fracture of a valve, wear of piston rings, etc., in the rows, while it shows the variations of the parameters in the columns (in a number equal to the number of parameters being monitored).

Under each variation, the rows corresponding to the possible anomaly or cause which may have caused this variation are "flagged".

By subsequently checking the rows of the aforesaid matrix, it is possible to identify with greater probability the anomaly which may have caused the variations of the parameters which have been encountered.

The matrix also contains the variations of parameters such as the temperatures of the valve covers, the temperatures of the main bearings, etc. which are not processed by the design program but which are the result of anomalies.

The anomalies which have been encountered are then displayed on the display unit of the system.

The invention claimed is:

1. A method for monitoring a reciprocating compressor, comprising:

reading from sensors, associated with the reciprocating compressor, data corresponding to measured parameters relating to an operating state of the reciprocating compressor;

reading manually entered data corresponding to manually entered parameters relating to the operating state of the reciprocating compressor;

reading from a first database reference parameters relating to the operating state of the reciprocating compressor;

reading operating parameters of the reciprocating compressor that are calculated by a design program;

performing a first comparison by analyzing the reference parameters with respect to the measured parameters, the manually entered parameters, and the operating parameters;

performing a second comparison by analyzing the reference parameters with respect to the measured parameters, and the manually entered parameters;

detecting whether an anomaly exists based on results of the first and second comparisons; and if an anomaly is detected in the first and second comparisons, performing a search in a second database to find a match of previously stored data correlated with predetermined anomalies and corresponding characteristics of the predetermined anomalies, and sending a signal according to the match, the signal indicating characteristics of the detected anomaly of the operating state of the reciprocating compressor, wherein the measured parameters and the manually entered parameters related to the operating state of the reciprocating compressor include one or more of an intake pressure of a first stage of the reciprocating compressor, an intake temperature of each stage of the reciprocating compressor, a delivery pressure of a last stage of the reciprocating compressor, a composition of the gas, an ambient pressure of the reciprocating compressor, a speed of rotation of the reciprocating compressor, and a temperature of a cooling fluid at an inlet and an outlet of the reciprocating compressor cylinders, and wherein the operating parameters include one or more of a gas flow rate, a delivery pressure of each stage except the last stage of the reciprocating compressor, a delivery temperature at each stage of the reciprocating compressor, a power consumption of the reciprocating compressor and forces acting on the reciprocating compressor and the operating parameters are calculated by the design program based on the measured parameters and the manually entered parameters related to the operating state of the reciprocating compressor.

2. The method of claim 1, further comprising:

obtaining data from design specifications of the reciprocating compressor; and performing a third comparison between the data from the design specifications and the data measured by the sensors to determine whether there is design conformity with the design specifications.

3. The method of claim 2, further comprising:

receiving the results of the third comparison as inputs for the design program for the reciprocating compressor, wherein outputs of the design program comprises the operating parameters.

4. The method of claim 1, wherein the second database comprises a matrix in which each row represents values of the parameters relating to the operating state of the reciprocating compressor associated with a specific anomaly.

5. A system for monitoring a reciprocating compressor, comprising:

one or more sensors associated with the reciprocating compressor;

a measuring unit configured to read data from the one or more sensors corresponding to measured parameters relating to an operating state of the reciprocating compressor; and a processing unit coupled to the measuring unit, the processing unit configured to receive the data corresponding to the measured parameters from the measuring unit, reference parameters from a first database, manually entered data corresponding to manually entered parameters, and operating parameters from a design program, wherein the processing unit is configured to perform a first comparison by analyzing the reference parameters with respect to the measured parameters, the manually entered parameters, and the operating parameters, and to perform a second comparison by analyzing the reference parameters with respect to the measured parameters, and the manually entered parameters, wherein the processing unit is configured to detect an anomaly based on results of the first and second comparisons, and to perform a search in a second database to find a match of previously stored data correlated with predetermined anomalies and corresponding characteristics of the predetermined anomalies if an anomaly is detected in the first and second comparisons, wherein the processing unit is configured to send a signal according to the match, the signal indicating characteristics of the detected anomaly of the operating state of the reciprocating compressor, wherein the measured parameters and the manually entered parameters related to the operating state of the reciprocating compressor include one or more of an intake pressure of a first stage of the reciprocating compressor, an intake temperature of each stage of the reciprocating compressor, a delivery pressure of a last stage of the reciprocating compressor, a composition of the gas, an ambient pressure of the reciprocating compressor, a speed of rotation of the reciprocating compressor, and a temperature of a cooling fluid at an inlet and an outlet of the reciprocating compressor cylinders, and wherein the operating parameters include one or more of a gas flow rate, a delivery pressure of each stage except the last stage of the reciprocating compressor, a delivery temperature at each stage of the reciprocating compressor, a power consumption of the reciprocating compressor and forces acting on the reciprocating compressor and the operating parameters are calculated by the design program based on the measured parameters and the manually entered parameters related to the operating state of the reciprocating compressor.

6. The system of claim 5, wherein the processing unit is operable to obtain data from design specifications of the reciprocating compressor and to perform a third comparison between the data from the design specifications and the data measured by the sensors to determine whether there is design conformity with the design specifications.

7. The system of claim 6, wherein the processing unit is operable to receive the results of the third comparison as inputs for the design program for the reciprocating compressor, wherein outputs of the design program comprises the operating parameters.

8. The system of claim 5, wherein the second database comprises a matrix in which each row represents values of the parameters relating to the operating state of the reciprocating compressor associated with a specific anomaly.

9. The method of claim 1, further comprising:

independently performing the first and second comparisons.

10. The method of claim 2, further comprising:

displaying, based on the third comparison, an indication that at least a parameter of the reciprocating compressor is not compliant with a design specification.

11. The system of claim 5, wherein the processing unit is further configured to:

independently perform the first and second comparisons.

12. The system of claim 6, wherein the processing unit is further configured to:

generate a display signal, based on the third comparison, that is indicative that at least a parameter of the reciprocating compressor is not compliant with a design specification.

13. A computer readable medium including computer executable instructions, wherein the instructions, when executed, implement a method for monitoring a reciprocating compressor, the method comprising:

reading from sensors, associated with the reciprocating compressor, data corresponding to measured parameters relating to an operating state of the reciprocating compressor;

reading manually entered data corresponding to manually entered parameters relating to the operating state of the reciprocating compressor;

reading from a first database reference parameters relating to the operating state of the reciprocating compressor;

reading operating parameters of the reciprocating compressor that are calculated by a design program;

performing a first comparison by analyzing the reference parameters with respect to the measured parameters, the manually entered parameters, and the operating parameters;

performing a second comparison by analyzing the reference parameters with respect to the measured parameters, and the manually entered parameters;

detecting whether an anomaly exists based on results of the first and second comparisons; and if an anomaly is detected in the first and second comparisons, performing a search in a second database to find a match of previously stored data correlated with predetermined anomalies and corresponding characteristics of the predetermined anomalies, and sending a signal according to the match, the signal indicating characteristics of the detected anomaly of the operating state of the reciprocating compressor, wherein the measured parameters and the manually entered parameters related to the operating state of the reciprocating compressor include one or more of an intake pressure of a first stage of the reciprocating compressor, an intake temperature of each stage of the reciprocating compressor, a delivery pressure of a last stage of the reciprocating compressor, a composition of the gas, an ambient pressure of the reciprocating compressor, a speed of rotation of the reciprocating compressor, and a temperature of a cooling fluid at an inlet and an outlet of the reciprocating compressor cylinders, and wherein the operating parameters include one or more of a gas flow rate, a delivery pressure of each stage except the last stage of the reciprocating compressor, a delivery temperature at each stage of the reciprocating compressor, a power consumption of the reciprocating compressor and forces acting on the reciprocating compressor and the operating parameters are calculated by the design program based on the measured parameters and the manually entered parameters related to the operating state of the reciprocating compressor.

14. The medium of claim 13, further comprising:

obtaining data from design specifications of the reciprocating compressor; and performing a third comparison between the data from the design specifications and the data measured by the sensors to determine whether there is design conformity with the design specifications.

15. The medium of claim 14, further comprising:

receiving the results of the third comparison as inputs for the design program for the reciprocating compressor, wherein outputs of this design program comprises the operating parameters.

16. The medium of claim 13, wherein the second database comprises a matrix in which each row represents values of the parameters relating to the operating state of the reciprocating compressor associated with a specific anomaly.

17. The medium of claim 13, further comprising:

independently performing the first and second comparisons.

18. The medium of claim 14, further comprising:

displaying, based on the third comparison, an indication that at least a parameter of the reciprocating compressor is not compliant with a design specification.

* * * * *